United States Patent [19]

Mast

[11] Patent Number: 4,805,734

[45] Date of Patent: Feb. 21, 1989

[54] ACOUSTIC WALL

[75] Inventor: Werner Mast, Niedermohr, Fed. Rep. of Germany

[73] Assignee: Mast Garten - und Landschaftsbau KG, Niedermohr, Fed. Rep. of Germany

[21] Appl. No.: 34,123

[22] Filed: Apr. 2, 1987

[51] Int. Cl.[4] ..... E04H 17/00; G10K 11/00

[52] U.S. Cl. ..... 181/210; 181/284

[58] Field of Search ..... 181/210, 284

[56] References Cited

U.S. PATENT DOCUMENTS 4,643,271 2/1987 Coburn ..... 181/284 X

FOREIGN PATENT DOCUMENTS 2744335 4/1979 Fed. Rep. of Germany ..... 181/284
2744473 4/1979 Fed. Rep. of Germany ..... 181/210
3043876 9/1982 Fed. Rep. of Germany ..... 181/210

*Primary Examiner*—B. R. Fuller
*Attorney, Agent, or Firm*—Flynn, Thiel, Boutell, & Tanis

[57] ABSTRACT

An acoustic wall for streets and parks and for garden-like designs consisting of several substantially U-shaped frame members arranged at a distance from one another, which frame members are connected among one another and have mats applied on their front and side surfaces. In order to substantially reduce the manufacture on location, the duration of setting up and the greening time on location, the acoustic wall consists of individual elements of which each has several U-shaped frame members which are secured at the ends of their long legs on a base. The base forms a rigid frame with fastening means for a lift for the lifting and transporting of the acoustic wall. One or several narrow-mesh mats are secured on the base, which mats prevent a falling out of material filled into the acoustic wall during transport.

10 Claims, 8 Drawing Sheets

ACOUSTIC WALL

BACKGROUND OF THE INVENTION

The invention relates to an acoustic wall for streets and parks and for the gardenlike design comprising several substantially U-shaped frame members arranged one behind the other and spaced from one another, which U-shaped frame members are connected among one another and have mats on their front and side surfaces. Such acoustic walls are used in order to reduce the spread of traffic noise.

BACKGROUND OF THE INVENTION

It is known to utilize acoustic walls made of plates and posts or, however, acoustic walls in the form of build-up dams and also those where the acoustic walls have an inner frame which is filled with earth and which is subsequently placed into a designated location. The latter acoustic walls have the advantage that they require a substantially smaller area than dams.

Such acoustic walls are generally manufactured by first creating a foundation in which the substantially U-shaped frame parts are anchored. The U-shaped frame parts are connected by means of traverse members to support one another or, however, are supported with respect to one another by bracing wires. After setting up this frame, mats of a relatively narrow-mesh netting are mounted onto the frame, which mats have the purpose of holding the earth material within the acoustic wall. The wall is subsequently provided with plants. This work is relatively time consuming. Furthermore one must add that the newly erected acoustic walls, even within a longer period of time after the erection, show no vegetation yet.

The basic purpose of the invention is to provide an acoustic wall of the abovementioned type so that the advantages of the acoustic wall are maintained, that, however, the duration of construction and the erecting time of the acoustic wall are substantially reduced and it is possible to erect the acoustic wall already with green vegetation.

According to the invention, the acoustic wall thus consists of substantially U-shaped constructed frame members which are connected among one another by mats and/or traverse members and are, if desired, reinforced among one another by means of bracing wires. The frame members are secured on a rigid base which is constructed such that same can absorb the entire load of the acoustic wall, so that the acoustic wall can be lifted and transported by means of a suitable lift. Such an acoustic wall preferably has a length permitting it to be transported without difficulties by trucks on public streets. The base consists advantageously of two longitudinal girders which are connected by two or more crossbeams and on which fastening means for connecting of a lift are arranged. Pegs are preferably arranged on the longitudinal girders, which pegs are placed into the ends of the long legs of the U-profiles. This achieves a simple and quick mounting of the acoustic wall. A corrosion-resistant structural-steel mat is mounted on the base, on which a fine-mesh mat can be additionally placed, for example a coconut mat preventing a falling out of the fill material during transport. A similar coconut mat is preferably arranged under the mats arranged laterally and on the front, whereby the coconut mats can at the same time also contain grass seed, so that a uniform greening of the ground is obtained.

Acoustic walls according to the invention can be premanufactured and already receive vegetation at the factory, so that the time needed for the actual setting up of the acoustic wall can be comparatively significantly reduced. Foundations are not needed.

BRIEF DESCRIPTION OF THE DRAWINGS

One exemplary embodiment will be described in greater detail hereinafter in connection with the drawings, in which.

DETAILED DESCRIPTION

Figure 1:
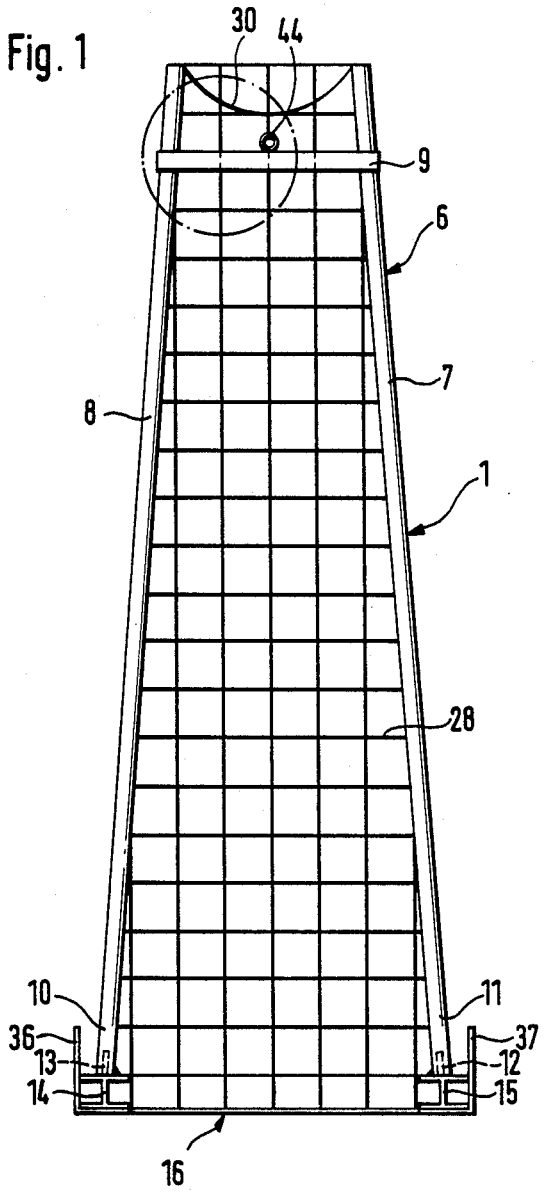
FIG. 1 is a front view of an inventively constructed element of an acoustic wall.
Figure 2:
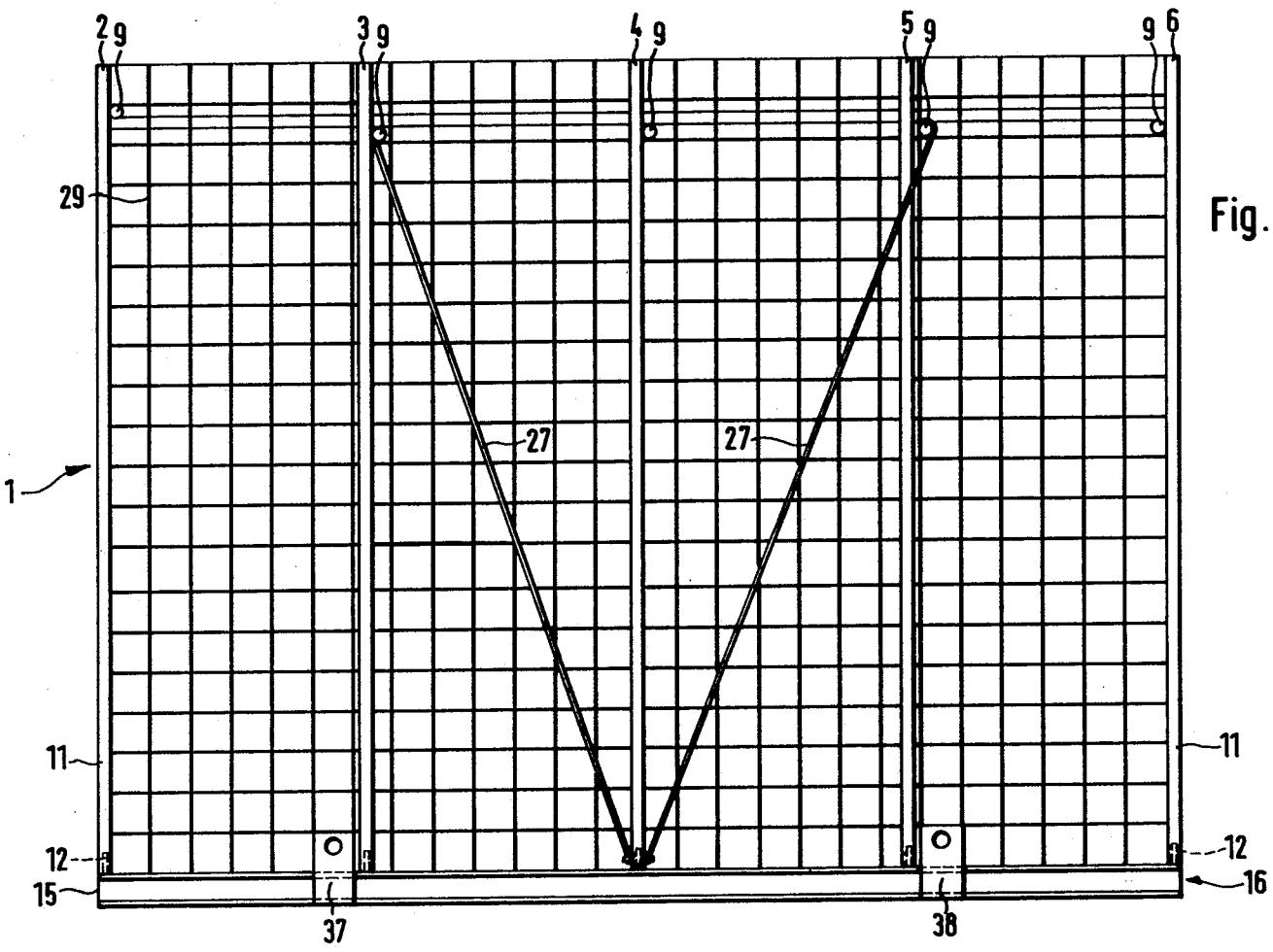
FIG. 2 is a side view of the element of the acoustic wall shown in FIG. 1.

The acoustic wall 1 illustrated in the drawings consist of five side-by-side substantially U-shaped frame members 2 to 6, each of which consist of two upstanding long legs 7, 8 which are connected adjacent their upper ends by a crossbeam 9. The frame parts 2 to 6 are spaced from one another so that planes containing the legs of the U extend parallel to each other. The lower ends 10, 11 of the long legs 7, 8 are mounted on pegs 12, 13 which are secured at predetermined intervals on longitudinal girders 14, 15 of a base identified in its entirety by the reference numeral 16. The long legs 7, 8 in the exemplary embodiment consist substantially of pipes, the inside diameter of each of which is slightly greater than the diameter of the pegs 12, 13.

Figure 4:
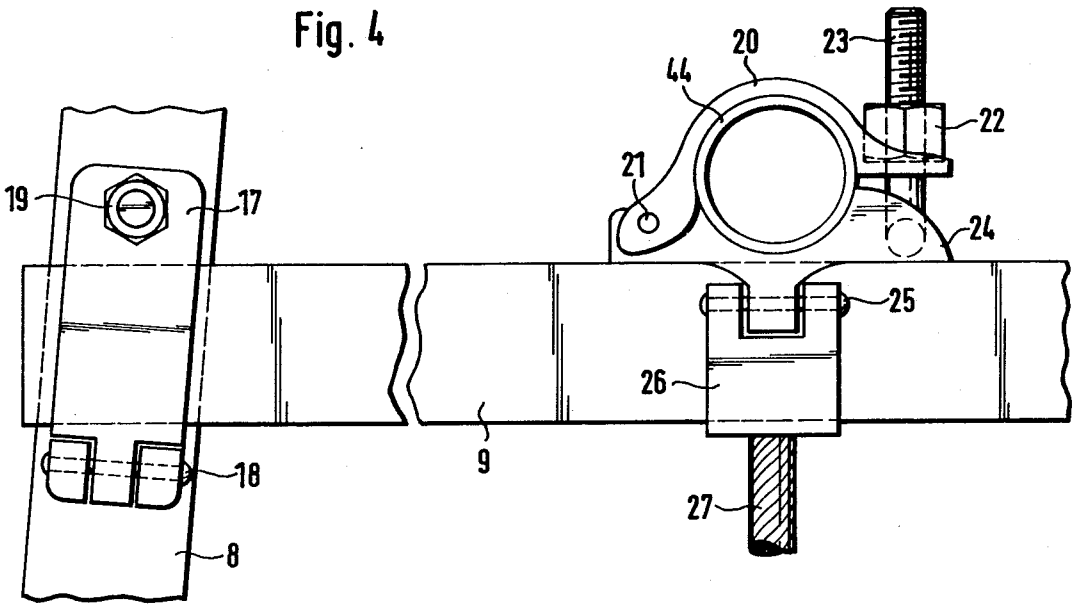
FIG. 4 illustrates the fastening of the connecting bars on the U-profiles of the element of the acoustic wall according to FIGS. 1–3.
Figure 5:
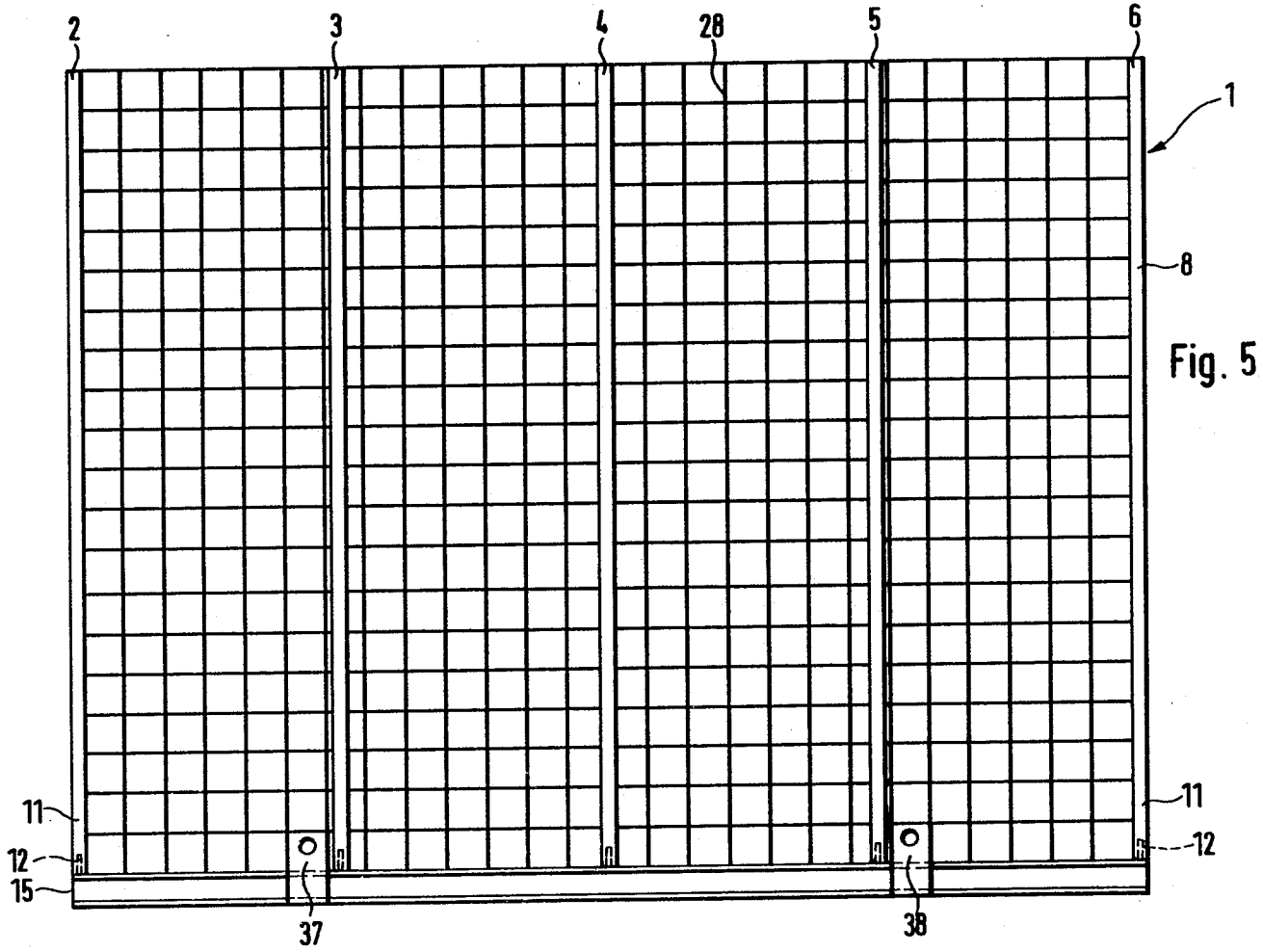
FIG. 5 is a side view of a further embodiment of an element of an acoustic wall.

The upper crossbeams 9 are arranged approximately below the end of the long leg of the U-profiles or frame members 2 to 6. A longitudinal traverse member 44 is secured to the crossbeams 9 of each U-shaped frame. The longitudinal traverse member is connected to all crossbeams 9. FIG. 4 is an enlarged illustration of the part of the upper end of the acoustic wall 1. The crossbeam 9 is connected with the long legs 7, 8 by means of a clamp strap 17 which is pivotal about a pivot bearing 18 and can be clamped by means of a nut and screw assemblage 19. The longitudinal traverse member 44 is secured on the crossbeam 9 by means of an identical clamp strap 20. The clamp strap 20 is pivotal about a pivot bearing 21 and is clamped by means of a nut 22 screwed onto a screw thread 23. A connecting piece 26 is secured pivotally about a bearing 25 on the part 24 of the clamp strap 20 secured on the crossbeam 9. A bracing wire 27 engages the connecting piece 26 at one end with the other end being secured to the longitudial girder 14 or 15 of the base 16. Corrosion-resistant structural-steel mats 28, 29 are secured both on the sidewalls and also the front walls of the acoustic wall 1, which mats are either welded to the U-shaped frame members 2 to 6 or, however, are tied thereto by means of corrosion-resistant wire. The upwardly facing surface remains open, whereby the earth filled into the acoustic wall 1 is constructed trough-shaped in the upper area 30. More earth can easily be added through the upper opening in order to compensate for possible settling. Moreover, the trough-shaped construction has the advantage of better absorbing and accumulating water and moreover it is possible to arrange in this area within the acoustic wall 1 a watering pipeline, whereby it is assured during watering that the water penetrates into the wall instead of running off the side of the wall.

Figure 3:
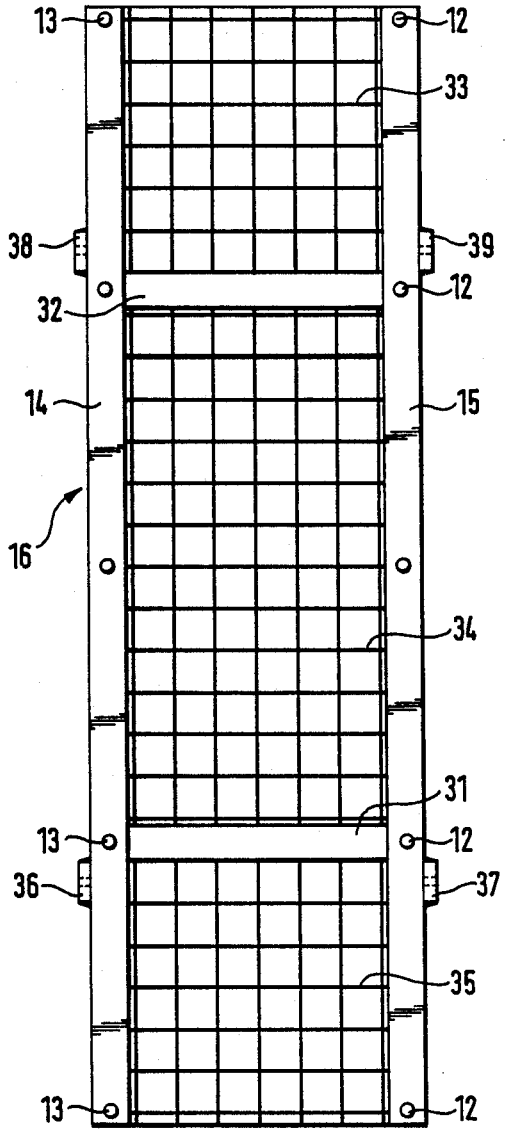
FIG. 3 is a top view of the base of the element of an acoustic wall according to FIGS. 1 and 2.

The base 16 is illustrated in the top view in FIG. 3. It consists of the two longitudinal girders 14, 15 which are connected by crossbeams 31, 32. As FIG. 1 shows, the longitudinal girders and also the crossbeams are of a high strength double-T profile. Corrosion-resisting structural-steel mats 33 to 35 are welded onto the longitudinal girders and crossbeams, which mats carry the filled-in earth. If a relatively large mesh size is chosen here, it is preferably to place also a coconut matting onto the structural-steel mats. The same is true for the structural-steel mats arranged on the sides and the front walls.

Four connecting points 36 and 39 are arranged on the longitudinal girders of the base 16. A lift can be connected to the points lifting the assembled acoustic wall filled with earth.

An acoustic wall according to FIGS. 1 to 4 can easily be transported and can be premanufactured industrially in a plant, can there be filled and can be colored or decorated prior to being transported to its predetermined location. The construction is less expensive and has the advantage that the remaining labor at the place of installation is limited only to preparing the ground and the connecting of a possible supply line.

Figure 6:
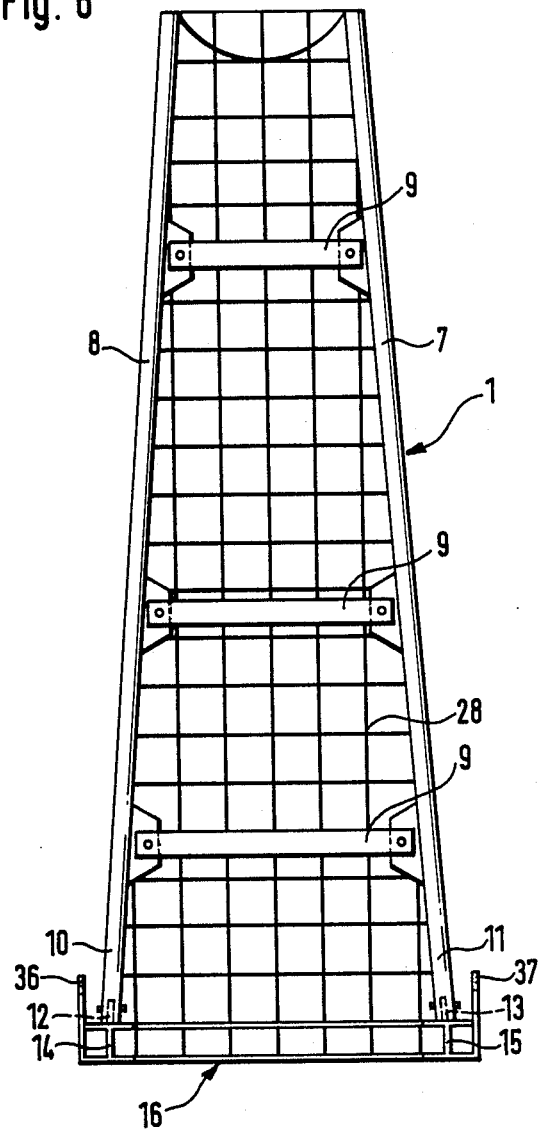
FIG. 6 is a front view of the element illustrated in FIG. 5, and FIGS. 7 and 8 show details of the element according to FIGS. 5 and 6 in an enlarged illustration.
Figure 7:
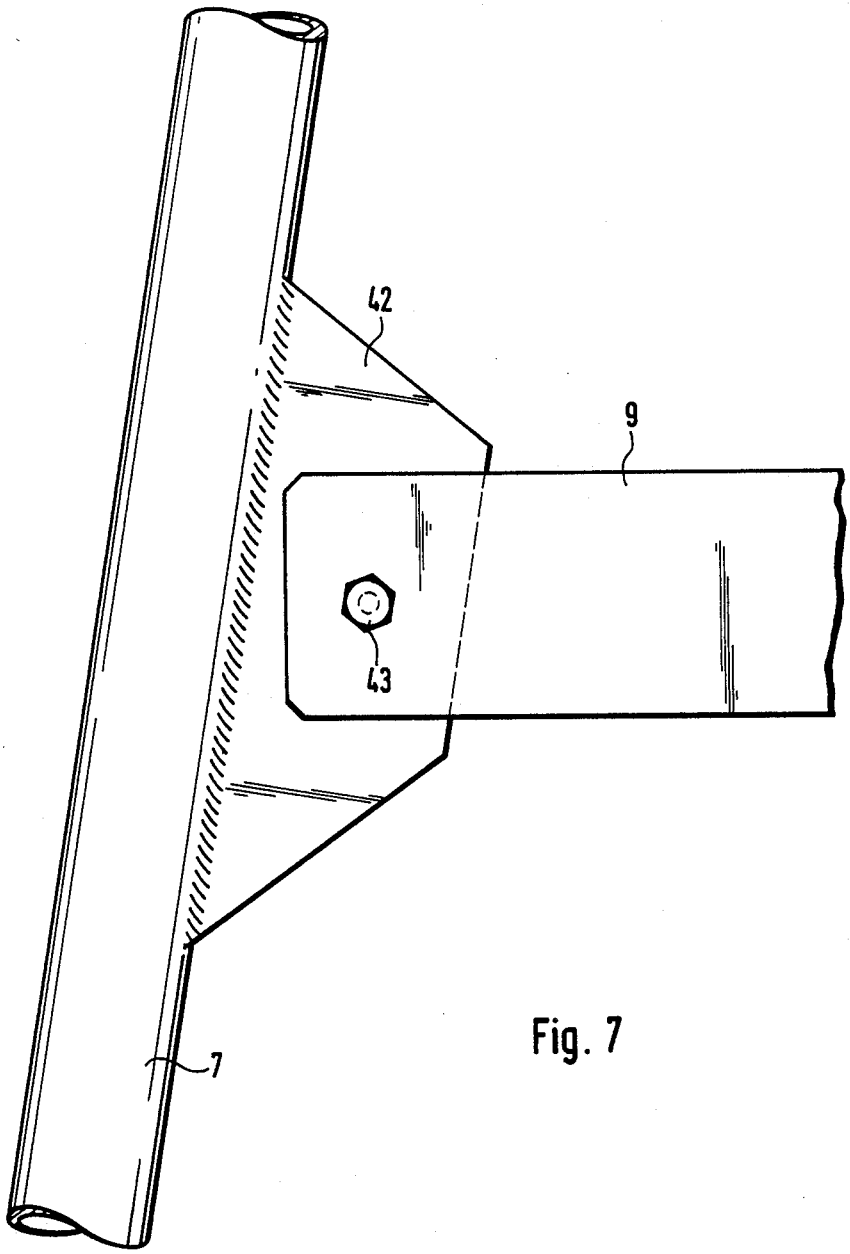
Figure 8:
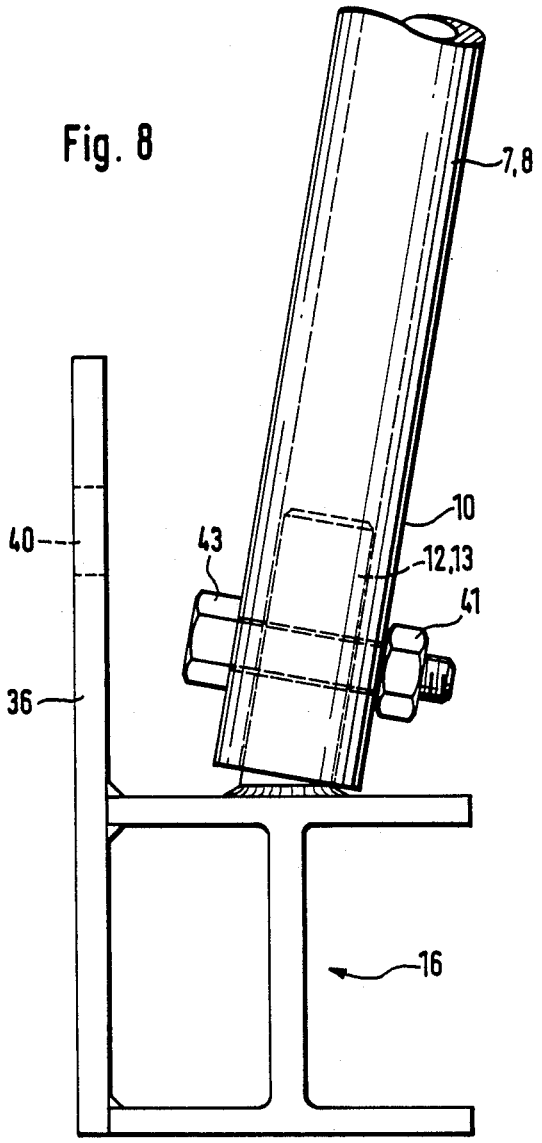

In the exemplary embodiments according to FIGS. 6 to 8, the same parts have the same reference numerals. The exemplary embodiment differs from the one according to FIGS. 1 to 4 in the upper longitudinal traverse member 44 not being present. Strength is achieved in this exemplary embodiment by the structural-steel mats 28, 29 being welded directly to the legs 7, 8 of the U-shaped frame members 2 to 6. Furthermore, this exemplary embodiment does not have one crossbeam 9, but three crossbeams arranged over the height thereof, which crossbeams substantially increase the strength of the element in transverse directin. FIG. 7 shows the connection of the crossbar 9 to the legs 7, 8. Fishplates 42 are welded to the legs 7, 8. The crossbeams 9 are secured to the fishplates by means of screws 43.

FIG. 8 illustrates the longitudinal girder 16, which consists of a double-T profile. The pegs 12, 13 are welded onto the longitudinal girder. The pegs 12, 13 have the same inclination as the legs 7, 8. The connecting points 36 to 39 are welded to the longitudinal girders. The connecting points 36 to 39 have receiving bores 40 for receiving the load hooks of a lift not illustrated.

Each of the elements, which are assembled to form a plant constructed acoustic wall, has a length which permits a transport by a truck on public roads and permits a loading and an unloading and a setting up with the help of heavy-duty cranes usable on streets.

The mats applied to the sidewalls of the elements preferably consist of structural-steel mats, the longitudinal rods of which are welded to the respective end frame members. The center frame members of each element are not connected to the structural-steel mat. Same is supported only with respect to the pipes. On the inwardly facing side of the U-shaped frame members there are welded the fishplates, which are chosen regarding distance and dimensioning depending on the static requirement.

Premanufactured structural-steel mats are fitted in and secured to the top sides of the elements. They are supposed to close the element member as a lost encasing until the set-up at its final location.

All structural-steel surfaces, like the bottom sidewalls and front surfaces are either prior to or after the installation lined with a vegetation mat or a suitable geotextile in order to avoid an escape of the fill material. Each element is subsequently filled with a vegetation-friendly and a favorable technical acoustic substrate. Should the combination of the fill material—for example a strongly cohesive earth—justify the fear of a one-sided slip joint, then the forces created by this can be absorbed by building in diagonal bars or ropes designed for tension and compression forces. The same applies when the acoustic wall is supposed to be banked up on one side.

After setting up the individual elements, the abutting elements are screwed together at their U-shaped frame members. This balances the tensions applied by the filling material onto the structural-steel netting, from element to element.

It is also conceivable to arrange the elements at a small distance from one another and to close off the gap between the elements with a further structural-steel mat, which is constructed with side parts, which are angled at 90° and which grip around the U-profiles of adjacent elements. The encasing structural-steel elements are also provided with a vegetation mat and are then filled before installation. It is moreover easily conceivable for optical reasons to cover each individual pipe element with a suitable mat. This is particularly preferable in the initial stage of the vegetation.

The embodiment of the invention in which an exclusive property or privilege is claimed are defined as follows:

1. An elongated, decorative, wall-like sound barrier member having front and rear facing surfaces and side facing surfaces, comprising a base, plural side-by-side inverted U-shaped frame parts upstand from said base, each said frame part having a pair of upstanding legs, said frame parts being spaced from one another and so that planes containing said legs extend parallel to each other, means for securing portions of said legs adjacent said base to said base so as to define a rigid frame, plural side mats mounted on said front facing surface and said side facing surfaces of said sound barrier member, at least one narrow-mesh floor mat being mounted on said base, said plural side mats and said floor mat defining an upwardly opening upper end of said rigid frame, said upwardly opening upper end being adapted to receive fill material therein, and fastening means on said base for facilitating a lifting of said rigid frame by a lifting device, said at least one narrow-mesh floor mat preventing said fill material from falling out of said rigid frame during transport.

2. The sound barrier member according to claim 1, wherein said base consists of two longitudinally extending girders and at least two transversely extending beams connected to said girders.

3. The sound barrier member according to claim 1, wherein said side mats and said floor mat each consist of corrosion resistant building steel.

4. The sound barrier member according to claim 1, wherein said inverted U-shaped frame parts each include said pair of upstanding legs and a crossbeam secured to and extending between portions of said legs located upwardly from said portions of said legs adjacent said base, said crossbeams each being connected to said base through at least one bracing wire.

5. The sound barrier member according to claim 4, wherein said crossbeams are each secured to said upstanding legs of said frame parts by means of clamp straps.

6. The sound barrier member according to claim 4, wherein a traverse member is secured to each of said crossbeams by means of a clamp means.

7. The sound barrier member according to claim 6, wherein one end of said at least one bracing wire is secured to a jointed connecting part of said clamp means.

8. The sound barrier member according to claim 2, wherein plural pegs are secured on said longitudinally extending girders of said base, which pegs extend into recesses provided in said lower end portions of said legs of said frame parts.

9. The sound barrier member according to claim 2, wherein said fastening means are arranged directly on said longitudinally extending girders.

10. The sound barrier member according to claim 4, wherein the length of said upstanding legs of said frame parts is extended upwardly beyond said crossbeams.

* * * * *